US006578873B2

(12) United States Patent
Pimpini

(10) Patent No.: US 6,578,873 B2
(45) Date of Patent: Jun. 17, 2003

(54) PHOTO ALBUM

(75) Inventor: Luciano Pimpini, Falconara Marittima (IT)

(73) Assignee: Promo Gift S.r.l., Falconara Marittima (IT)

( * ) Notice: Subject to any disclaimer, the term of this patent is extended or adjusted under 35 U.S.C. 154(b) by 0 days.

(21) Appl. No.: 09/906,611

(22) Filed: Jul. 18, 2001

(65) Prior Publication Data

US 2002/0021000 A1 Feb. 21, 2002

(30) Foreign Application Priority Data

Jul. 18, 2000 (IT) ..... AN2000 0021 U

(51) Int. Cl.[7] ..... B42D 1/00
(52) U.S. Cl. ..... 281/38; 281/21.1; 281/40
(58) Field of Search ..... 412/1, 8; 281/22, 281/21.1, 38, 40, 15.1; 402/79, 80 R, 80 L

(56) References Cited

U.S. PATENT DOCUMENTS 5,403,138 A * 4/1995 Otake et al. ..... 412/1 XZ
6,347,467 B1 * 2/2002 Meyer ..... 40/124.06

FOREIGN PATENT DOCUMENTS

GB 2 122 943 2/1984

* cited by examiner

*Primary Examiner*—Willmon Fridie, Jr.
(74) *Attorney, Agent, or Firm*—Young & Thompson

(57) ABSTRACT

The present invention refers to a photo album (1) suitable to contain a relatively large number of photographs printed through computers on pages (4) which are folded and combined with other pages (4) so as to form a block. The combination of said pages (4) is obtained through interposition between the external sides of two of said pages of a bi-adhesive relatively stiff paperboard, which has a basic weight ranging between 300 and 800 g/m⊠ and which is shorter at least 1.5 mm than the pages (4) wherein the paperboard has inserted. The paperboard (6) can be made bi-adhesive through the combination of a bi-adhesive film with any one of the two sides of the paperboard or sticking on every one of said sides a dry adhesive. Preferably, the back 3 is joined to the covers 2 only for a short line.

10 Claims, 2 Drawing Sheets

PHOTO ALBUM

BACKGROUND OF THE INVENTION

The present invention refers to a photo album, particularly suitable to contain a relatively large number of photographs, in particular photographs printed through computers.

In the last few years, techniques of photographic reproduction which employ computers to create images from digital signals, have been gradually increasing. The digital signals which store such images, are mostly acquired by special cameras, called "digicamera" or the like and the images can be printed with a computer, through a special printer on a special paper, whose name is "digital photographic paper".

Since full page prints can be easily obtained, therefore it is becoming frequent that the above described technique is used even for displaying exhibitions and/or ceremonies, which have always been collected in suitable photo albums, and are generally quite large and heavy. A typical example of this type, are the photo albums designed for marriages, for which the biggest images are particularly appreciated.

So far the attempts made to create photo albums of such a type, wherein the pages open showing a single large image on a full page (as it happens, for example for the traditional photographs—realized on standard paper using the technique called offset—in some tourist booklets, have failed, or they have produced images of inferior quality, since it is very difficult to stick the back of the pages between them: the photographic paper consists of a polyethylene film as back support and therefore it is very difficult to stick and the pages, once stuck, do not exhibit an adequate thickness such to avoid the case where the page corrugates, generating the phenomenon of bending; the film nevertheless does not allow a lasting and precise cohesion without defects on the surface of the image.

SUMMARY OF THE INVENTION

All of these drawbacks can be brilliantly solved by this invention, relating to a photo album suitable to contain even a large number of photographs printed using photographic paper on pages which are folded by means of mechanical creasing wherein the images face inwardly and are each other combined joining the external sides not having images during the binding, characterized in that the combination of said pages in the binding is obtained through interposition between said external sides of two of the said pages of a bi-adhesive relatively stiff paperboard.

Preferably, such paperboard has a basis weight ranging from 300 and 800 g/m$^2$ and said photographs are printed using computers.

BRIEF DESCRIPTION OF DRAWINGS

The present invention will be now described in detail, taking as reference the enclosed drawing, wherein.

BEST WAY OF CARRYING OUT THE INVENTION

An album 1, according to the present invention, is composed of cover plates 2, a back 3 and pages 4.

Figure 1:
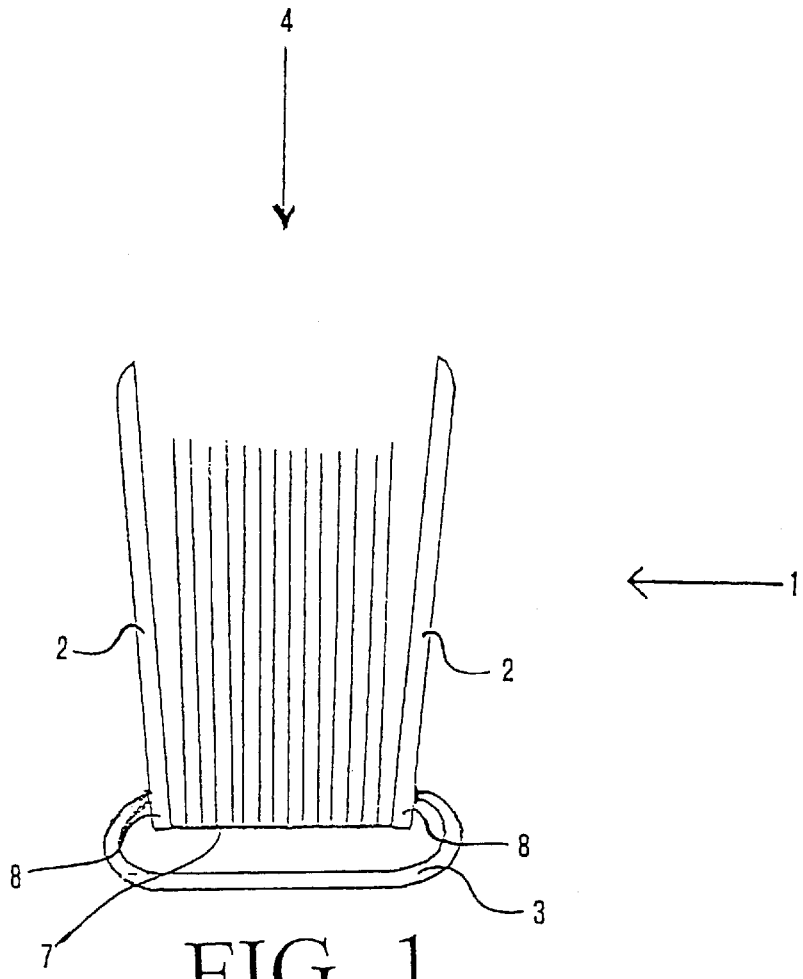
FIG. 1 shows a plan view of the photo album according to the present invention.
Figure 2:
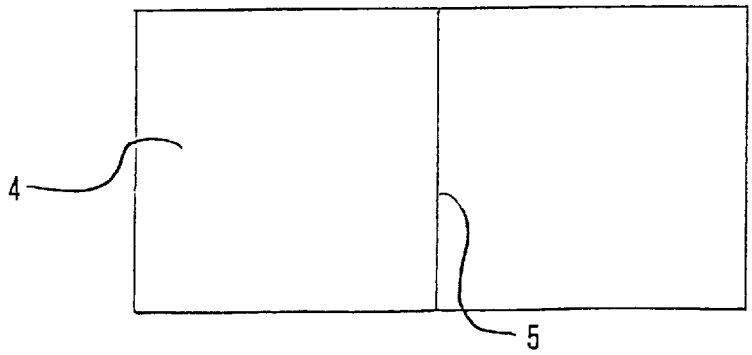
FIG. 2 shows a plan view of a page of the album according to the present invention, before the realisation of the album itself.

FIG. 2 shows a plan view of page 4. The page 4 has been printed through a special printer, with images on digital photographic paper. In he middle of page 4, an imaginary center or division line 5, can represent the folding of page 4 by means of mechanical creasing and which will be called, just for simplicity sake, creasing 5.

In the assembled album, the pages are stiffened by interposing a paperboard 6 between them. The creasings 5 are entirely combined with each other with a back 7.

Figure 3:
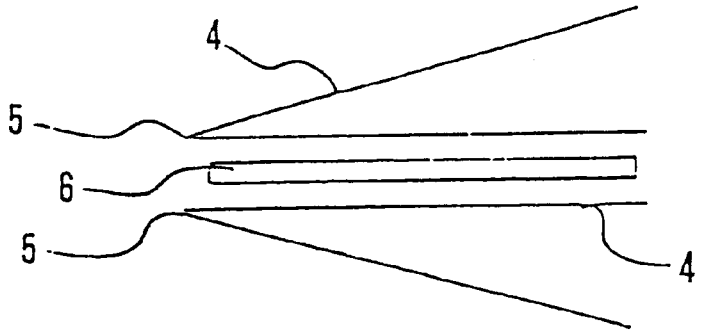
FIG. 3 shows a side view which highlights the junction of two pages of the said photo album according to the invention.
Figure 4:
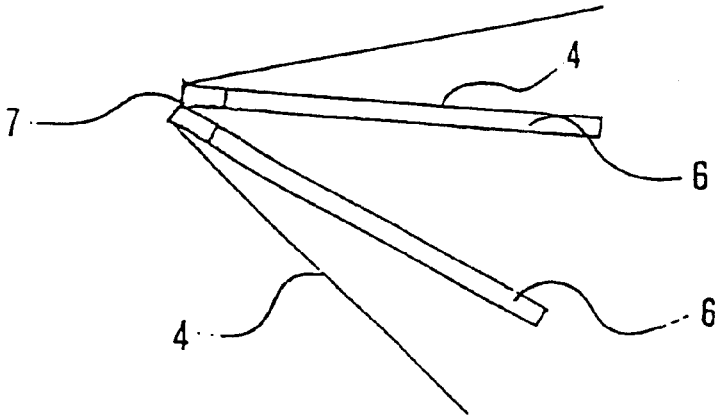
FIG. 4 shows a side view which highlights some of the pages of the album according to the invention, after the junction.

To produce the album 1 according to the invention, it is first necessary to print the image or the images on the full page 4. The page 4 is creased on the division line 5, taking care to let the image or the images face inside. It follows that for a set of pages 4, each page is folded with the images reciprocally placed side by side, as shown in FIG. 3. Two of these pages are combined, interposing between one of the back sides of the first and one of the back sides of the second a relatively stiff paperboard 6; the preferred basis weight is ranging between 300 to 800 g/m$^2$. Any one of the prior arts, such as, for example, that to combine any one of the sides of a paperboard with a dry bi-adhesive film, can make the paperboard 6 bi-adhesive. In this way, the external sides of the two pages 4 (see FIG. 3) are firmly stuck on the paperboard 6, meanwhile obtaining the stiffening. The process can be repeated as long as all the pages 4 of the album 1 have been combined so as to form a block. The bi-adhesive layer on the paperboard 6 can be of all kinds, as long as it is smooth and compatible with the back support of the image. In particular a bi-adhesive film can be stuck on every one of the two sides of the paperboard, or layers of adhesive can be applied on every one of the two sides, by means of silk-screen printing. It is preferable to employ adhesives which allow a dry combination, so as to avoid the complicated steps of drying.

Advantageously, a distance ranging between 1.5 and 3 mm exists between the back 7 of the block of the pages 4 and the paperboard 6, so as avoid the contacts of the parties while leafing through the pages.

The following step represents the combination, among them, of the creasings 5 of all the pages 4 to form the back 7. The back gives to the block of the pages 4 a wider thickness and a better aesthetical effect, which can be also provided by applying a bi-adhesive tape on and placing on it a decorative fabric, for example a non-woven fabric.

The question is, at this point, to combine the back so obtained with the cover plates 2 and with the back 3 of the album 1. The plates 2 can be combined as in any one of the prior art, so as to leave, for example, the two flyleafs of the album lacking in images and stick them on the plates 2.

The album can be stronger and easier to leaf through if the back 3 is effectively let separated from the end strip 8 of every one of the plates 2, rather than if it is combined with them on all the contact surface. The said strip may have an ideal width ranging between 1 to 5 cm, preferably being of 3 cm.

The album according to the present invention therefore, allows to preview the photographs printed on photographic paper as on a vision effect, particularly suggestive for the images on full page.

The paperboard 6 makes the page 4 sufficiently stiff, so as the said page remains perfectly flat and can be leafed through and carried without causing any kind of damage at all.

Moreover, the said paperboard gives the album an important and pleasant structure from a visual point of view.

An album of such a type allows the binding of about 50 pages 4 at a time.

A particular pleasant effect is obtained by using handmade leather covers; in this way the album 1 combines the modernity of the new technique of photographic reproduction with the skilled craft of binding and of leather maufacturing.

Moreover, the said paperboard gives the album of an important and pleasant structure from the visual point of view.

An album of such a type allows the binding of about 50 pages 4 a time.

A particular pleasantness effect is obtained by using handmade leather covers; in this way the album 1 combines the modernity of the new technique of photographic reproduction with the skilled craft of binding and of leather manufacturing.

What is claimed is:

1. A photo album comprising:

a plurality of pages, each said plural pages having first and second sides, each said first side having a single image thereon, each said plural pages being folded substantially in half so that each said plural pages has first and second halves; and paperboard connected to each said second side, between one of said first and second halves of one of said plural pages and one of said first and second halves of another one of said plural pages, so that when said photo album is in an open position, only the single image of one of the plural pages is visible.

2. The photo album according to claim 1, wherein the plural pages are computer generable.

3. The photo album according to claim 2, wherein the paperboard has a basis weight between 300 and 800 g/m$^2$.

4. The photo album according to claim 3, wherein each side of the paperboard comprises a two-sided adhesive.

5. The photo album according to claim 4, wherein the adhesive is a dry adhesive.

6. The photo album according to claim 3, further comprising:

first and second cover plates surrounding said plural pages; and a backing connecting said plural pages and said first and second cover plates, said backing having a portion separated from said first and second cover plates.

7. The photo album according to claim 6, wherein the portion is separated by between 1 and 5 cm.

8. The photo album according to claim 7, wherein the portion is separated by 3 cm.

9. The photo album according to claim 8, wherein an edge of each of said plural pages extends beyond the paperboard and is not supported by the paperboard.

10. The photo album according to claim 9, wherein the edge extends between 1.5 and 3 mm beyond the paperboard.

* * * * *